US005921896A

United States Patent [19]

Boland

[11] Patent Number: 5,921,896

[45] Date of Patent: Jul. 13, 1999

[54] EXERCISE DEVICE

[76] Inventor: Kevin O. Boland, 5623 Massachusetts Ave., Bethesda, Md. 20816

[21] Appl. No.: 09/148,625

[22] Filed: Sep. 4, 1998

Related U.S. Application Data

[51] Int. Cl.[6] ..... A63B 69/34

[52] U.S. Cl. ..... 482/83; 482/3; 482/84; 482/902

[58] Field of Search ..... 482/82–90, 1–9, 482/900–902; 73/379.04

[56] References Cited

U.S. PATENT DOCUMENTS

| | | | |
|---|---|---|---|
| 2,620,188 | 12/1952 | Malagio | 482/83 |
| 3,933,354 | 1/1976 | Goldfarb et al. . | |
| 4,557,478 | 12/1985 | Levine | 482/83 |
| 4,974,833 | 12/1990 | Hartman et al. | 482/84 |
| 5,221,243 | 6/1993 | Walker . | |
| 5,584,779 | 12/1996 | Knecht et al. . | |
| 5,716,302 | 2/1998 | Andersson | 482/83 |
| 5,723,786 | 3/1998 | Klapman | 73/379.04 |

*Primary Examiner*—Glenn E. Richman
*Attorney, Agent, or Firm*—Breneman & Georges

[57] ABSTRACT

An exercise device is provided having a resilient or flexible front impact surface and a plurality of identification indicia for identifying target areas on the flexible impact surface. The exercise device preferably utilizes lights as the identification indicia that are resiliently mounted to the exercise device which are sequentially operated by a microprocessor to force an athlete to contact the identified area on the impact surface while speed, strength and agility may be measured and analyzed by the microprocessor. The software for operating the microprocessor provides a wide range of workout levels and routines and imparts the ability to identify weak areas in the performance of the athlete and provide specific future training routines to improve overall performance in speed, agility and power.

25 Claims, 17 Drawing Sheets

Front Panel(Concept) - Option 1

Front Panel (Concept) - Option 2

Block Diagram - Electronic Controller - Option 1

Block Diagram – Electronic Controller – Option 2

Electonic Controller - Hardware Diagram - Option 2

Electonic Controller - Flow Diagram - Option 1

Electonic Controller - Flow Diagram - Option 2

Electonic Controller - Flow Diagram - Option 2

EXERCISE DEVICE

BACKGROUND OF THE INVENTION

1. Field of the Invention

The invention pertains to an exercise device having a flexible exercise bag resiliently mounted to a support or stand which may optionally include an athlete support surface. More particularly, the invention pertains to a flexible, resiliently mounted exercise device suitable for punching, kicking or striking in an exercise regimen wherein target segments of the exercise device are identified by a random or sequenced identification which preferably is provided by illumination but may also be identified by other identifying indicia such as sound or vibration. The identification of the target segment or segments of the novel exercise device in the preferred embodiment is accomplished by utilizing segment identification lights extending from the novel exercise device, disposed on the exercise device or embedded in the exercise device in a manner that provides identification of the target area of the exercise device that must be hit, kicked or punched by the athlete within a predetermined period of time. The computer-controlled exercise device provides a broad range of exercise regimens for exercising upper and lower portions of the body as well as allowing work and training on specific areas of the body while improving coordination, speed and strength.

2. Description Of Related Prior Art

Related prior art includes such devices as conventional low-tech punching bags as are currently used in the gyms which include hand punching bags, full-length body punching and kicking bags as well as other punching and kicking devices which traditionally have not been utilized with light, sound or other target area identification or computer software to identify a particular target area and provide a specific type of workout. Usually such devices are used in exercises prescribed by the trainer for a particular sport and seek to increase strength, speed and hand and eye coordination. Such prior art devices generally do not provide a combination of upper and lower body workout nor do such exercise devices sequence either randomly or in a particular regimen to allow specific areas of the body to be improved or improve overall stamina, speed, coordination or strength.

Other known prior art such as Goldfarb, et al. U.S. Pat. No. 3,933,354 provides a reflex testing amusement device which is an amusement game that utilizes a combination of light and sequencing in which a player or a plurality of players attempt to strike an illuminated light. Such illuminated prior art games are for the purpose of amusement and checking reflexes and speed as opposed to providing an exercise device to improve muscle tone, physical coordination and strength. In addition such prior art devices are not intended for athletic training for working on particular parts of the body or providing a particular exercise regimen for upper and lower portions of the body to provide an exercise workout for the athlete. Such amusement devices are not exercise devices and, unlike the invention, do not provide an exercise routine, where both speed, strength, agility and exercise are combined in a microprocessor-controlled exercise device.

Other known prior art exercise devices such as Knecht, et al. U.S. Pat. No. 5,584,779 provide a step exercising system and method where a plurality of step surfaces are provided which are identified through a cuing device to indicate to the user a particular sequence of steps to be stepped upon. While such devices provide exercise and coordination training for the lower portion of the body and increase speed and agility, such devices do not provide for a combination of speed, skill and strength or allow the training of an athlete by a computer to work on a particular skill or area of weakness, as is provided in accordance with the exercise device of the invention. In addition Knecht, et al. U.S. Pat. No. 5,584,779 does not utilize a target segmented flexible exercise bag having a light or other identifying means for identifying particular segments or areas to be punched, kicked or struck in a particular sequence to increase speed, skill and strength for boxing, kickboxing or other martial arts training.

The prior art also does not provide a multipurpose exercise and training device having a flexible target segmented surface for punching or kicking so as to exercise both the upper and lower body while identifying particular target segments of the flexible exercise device that must be punched or kicked to provide a training or exercise routine or workout which is controlled by software and a microprocessor and specifically designed for a variety of martial arts sports. The prior art also does not show a device in which the particular areas or segments of the exercise and training device are identified through lighting activated by the microprocessor in which the target area identification light is placed on stalks away from the exercise device or the light is provided in a resilient molding surrounding the flexible exercise device or is mounted in the exercise device and shielded from kicks or blows to the exercise device so as to protect not only the lighting but also the athlete from injury.

SUMMARY OF THE INVENTION

The invention pertains to an exercise device for boxing and martial arts training and exercise which includes a microprocessor, associated software and means for identifying a particular target area on an exercise device which may be punched, kicked or struck with the hand, foot or knee in a training regimen to increase strength, speed and agility while providing the flexibility for accommodating a wide range of exercise routines. The novel exercise device includes a flexible exercise body which preferably is resiliently mounted to a support terminating in legs which contact the floor and terminate in a base for supporting the body of the athlete. The legs may include resilient mounting means such as shock absorbers, springs, rubber bungee-type cords or other resilient means for mounting the support for the exercise device or the resilient mounting means may be disposed between the flexible exercise body and the support. The legs preferably form a U-shaped platform accommodating an elastomeric base cushioning the legs of the athlete and providing a non-slip surface to allow the athlete to punch as well as to kick the novel exercise device in response to the target area identified by the target identification means.

The novel exercise device includes a microprocessor and software for activating a target identification means which in the preferred embodiment includes one or more lights for identifying particular areas or segments of the exercise device. The lights may be disposed on stalks behind and away from the kicking and punching surface or may be placed in resilient molding surrounding the punching surface or may be coated or covered with a resilient layer or covering or embedded in the flexible exercise body at predetermined locations to identify the target area to be struck or kicked. The resilient covering or coating in the embedded embodiment serves to cover and protect the lights and prevent both injury to the athlete and the lights from being broken during exercise and training routines. Various types of elastomeric, transparent or translucent surfaces may be provided in the exercise device so that the lights may be mounted behind the elastomeric, transparent or translucent target area so that the target area can be safely illuminated on the novel exercise device. The illumination of the exercise device can be sequenced in any particular manner through the software which may be programmable to provide a wide variety of training workouts and exercise routines for boxing, kickboxing or other martial arts training exercises or be programmed by the individual to provide strength, agility and repetition training to strengthen or improve particular areas of the body.

The novel exercise body is preferably slidably mounted on the support so that it may be raised and lowered to suit the height requirements of a particular athlete. The flexible exercise body may be resiliently mounted either at the interface between the support and the flexible exercise body or between the support and the legs connected to the support.

The novel exercise device may include a meter for recording the number of punches as well as the force of the punches and the reaction time and cumulatively record timing of punches in various areas to assist in rating the performance of the workout session. In one embodiment of the invention the data collected may be compared with stored data in various competition levels in various martial arts and used in future training and workout routines to provide specific suggested areas of improvement and suggested workout routines. In addition the meter can also provide input as to calories burned in view of the time and force utilized in the exercise regimen.

The size and shape or configuration of the novel exercise device may be changed to suit particular sports or esthetic desires of the athlete and may be resiliently mounted in a number of ways to suit particular exercise or training requirements. The software may also be modified to provide a combination of advantages in analyzing and directing the training requirements of the athlete and provide suggestions for a particular regimen of exercise to accelerate speed, strength, agility or other desired characteristics. These and other advantages of the invention will be described in further detail with respect to the following Brief Description of the Drawing and Description of the Preferred Embodiment.

BRIEF DESCRIPTION OF THE DRAWING

The objects and advantages of the invention will become apparent to those skilled in the art from the following detailed description of the invention when read in conjunction with the accompanying drawings in which.

DESCRIPTION OF THE PREFERRED EMBODIMENT

Figure 1:
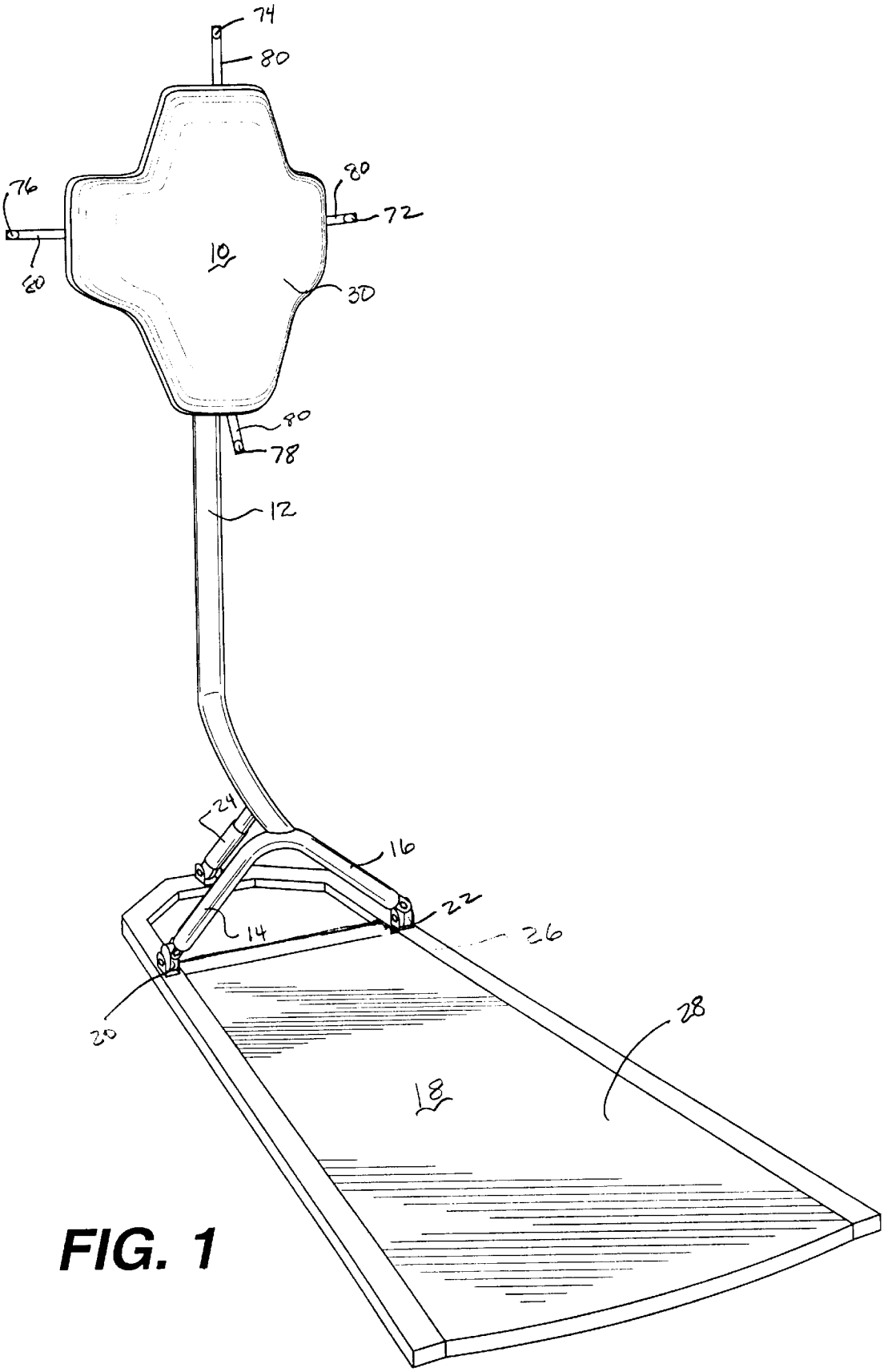
FIG. 1 is a perspective view of the novel exercise device including a support constructed in accordance with the invention.
Figure 2:
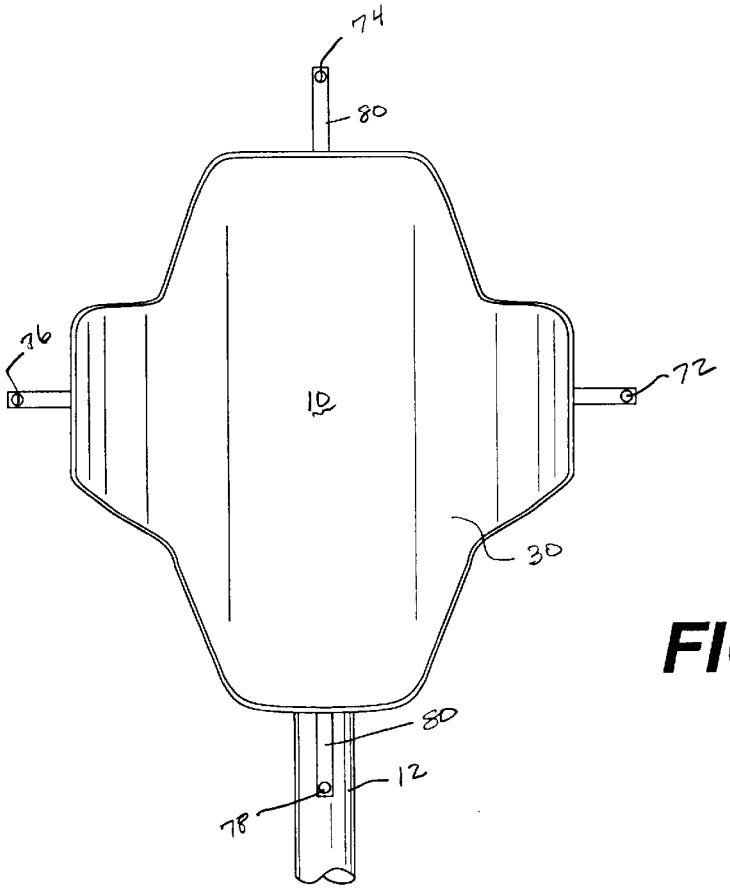
FIG. 2 is a front view of the novel exercise device with a fragmentary view of part of the support.

The invention provides a novel computer-controlled exercise and training device having a support or stand which preferably terminates in an athlete support surface. The novel exercise and training device includes a punching or kicking surface with means for sequentially identifying a target area of the exercise device to be struck by the athlete together with a microprocessor and software for selectively identifying a particular target area or segment of the exercise device. The exercise and training device is resiliently mounted to the support either at the junction between the exercise device and the support or between the support and athlete support surface as will be hereinafter described with respect to the preferred embodiments of the invention.

Referring now to FIGS. 1, 2, 3, 4, 5 and 8, the novel exercise device includes a flexible exercise body 10, having a support or stand 12 terminating in leg 14 and 16 which are pivotally articulated to an athlete support surface or platform 18 through pivotal joint 20 and 22 and resiliently articulated to platform 18 through a shock absorber 24. Shock absorber 24 provides a resilient mounting means which alternatively may be springs, bungee-type cords, rubber pucks or other such resilient mounting means. Shock absorber 24 is pivotally attached at end 25 to stand 12 (FIG. 4) and at the other end 27 to U-shaped frame 26 to provide a resilient mounting for exercise device 10. The resilient mounting provided by shock absorber 24 or other resilient means such as springs, rubber or other elastomeric materials allows forces directed to exercise body 10 to be dissipated through stand 12 and into U-shaped frame 26.

U-shaped frame 26 may be of a unitary construction or be constructed in sections which may be bolted together to make shipping and handling of the athlete support surface or platform 18 easier. Platform 18 may include a replaceable support pad 28 made of rubber, fabric, foam or some type of elastomeric material which is slip-resistant to resiliently support and cushion the feet of the athlete.

Figure 8:
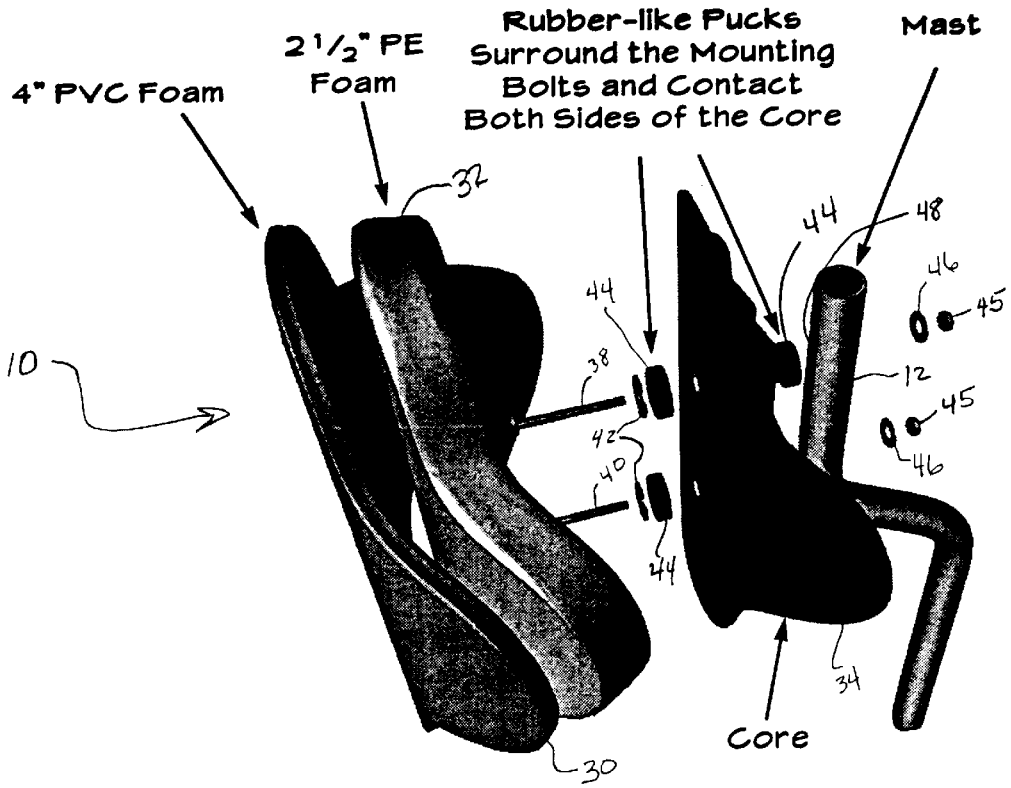
FIG. 8 is an exploded view of a novel exercise device similar to FIG. 1.

The exercise body 10 may be of a unitary construction or constructed in a layered arrangement as illustrated in FIG. 8 in which the outer surface 30 is constructed of vinyl, leather or high density foam of from about 2 to 8 inches thick which serves as an outer, wear-resistant layer. The outer surface 30 may be supported by a low density foam layer 32 which may be from about ½ inch to 4 inches thick for dissipating and cushioning energy directed toward the outer layer. Supporting foam layer 32 is a core backing 34 which contains a track 36 (FIG. 3) for receiving stand 12. Outer surface 30 may be bonded to layer 32 which is attached by bolts 38 and 40 and metal washers 42 through rubber pucks 44 to attach exercise body 10 through stand 12 by nuts 45 and washers 46. Adjustability of the exercise body on stand 12 can be accomplished in a number of ways including the utilization of a slot 48 for the elevational positioning of exercise body 10 with respect to stand 12 and platform 18.

Alternatively, adjustability of exercise body 10 can be accomplished by utilizing a knurled set nob 50 (FIG. 3) for tensionally engaging a fastening bolt or mechanism through one of the pluralities of adjustment holes 52 on stand 12. Track 36 and stand 12 may include a plurality of ridges or ribs (not shown) to assist in the elevational adjustment and positioning of exercise body 10 with respect to platform 18. Core backing 34 may include one or more ribs 54 for imparting structural integrity to core backing 34.

Figure 3:
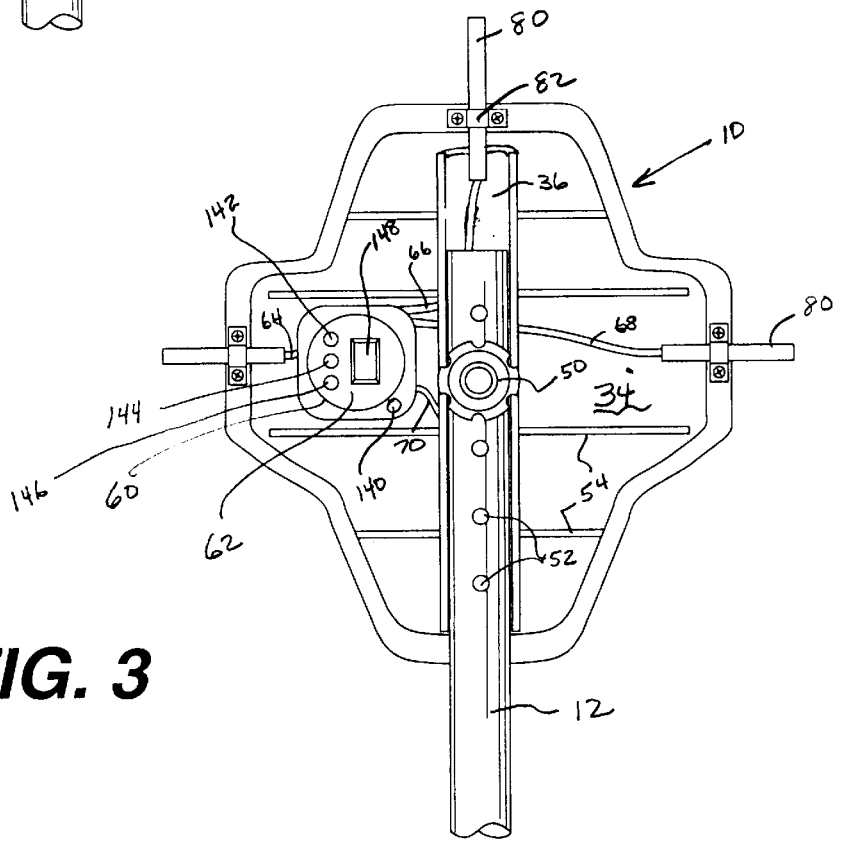
FIG. 3 is a rear view of FIG. 2.
Figure 4:
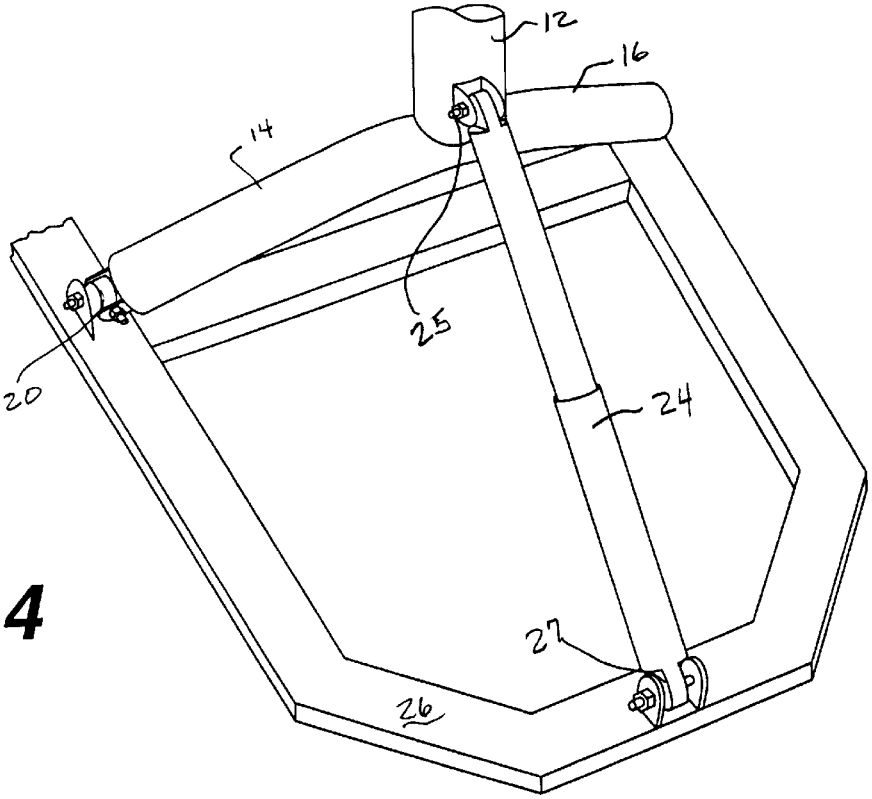
FIG. 4 is a fragmentary view of part of the base of FIG. 1.
Figure 5:
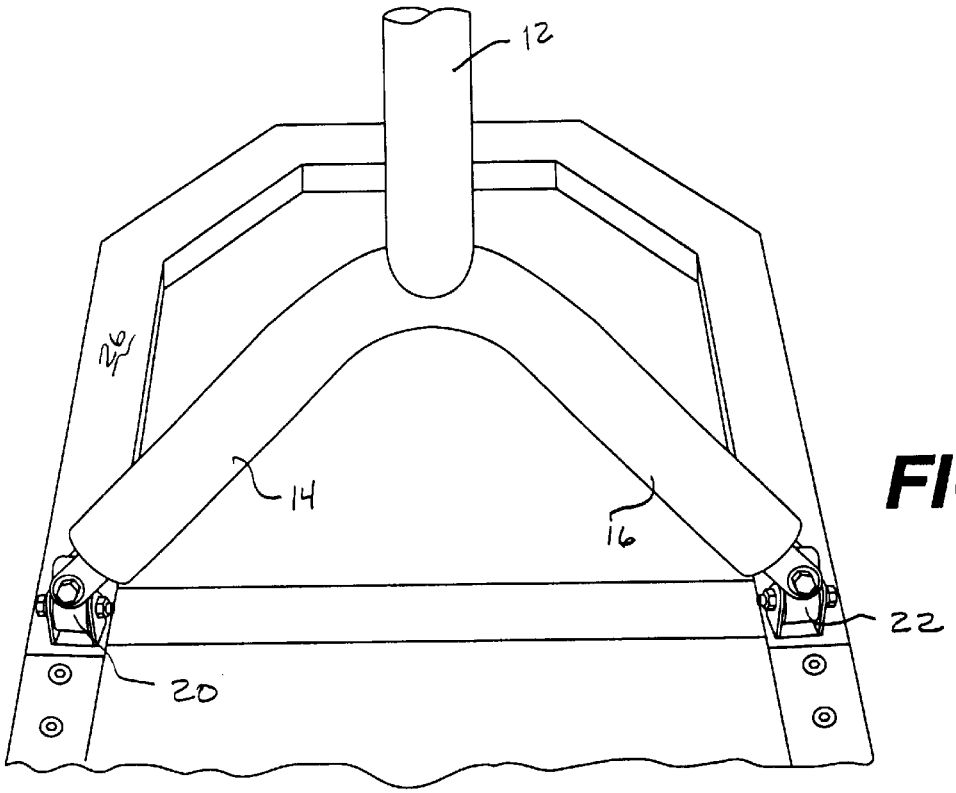
FIG. 5 is fragmentary view of a portion of the base of FIG. 1.

Referring now to FIG. 1, 2, 3, 6 and 7 exercise body 10 includes a microprocessor and software in electronic housing 60 (FIG. 3). Electronic housing 60 includes a display and control panel 62 for communicating with the microprocessor and providing for the operation of the identification means for identifying the target area. In the preferred embodiment the identification means is a lighting display associated with the exercise body so as to identify a particular target area or segments of the exercise body 10 that needs to be struck within a predetermined period of time in the exercise regimen. As illustrated in FIG. 3 electronic housing 60 includes wiring 64, 66, 68 and 70 for the identification lights 72, 74, 76 and 78. Identification light 72, 74, 76 and 78 are each mounted on a semi-resilient stalk 80 to hold the identification light adjacent to the target area to be struck within a predetermined period of time.

The semi-resilient stalk 80 resiliently supports the identification lights so that, if the identification light or stalk 80 is struck, it will flex and return to its original position. Each semi-resilient stalk 80 is secured to exercise body 10 by a U-shaped holder 82 (FIG. 3) on the reverse side of exercise device 10. The semi-resilient stalk 80 may be straight or curved to complement the curved surface of exercise body 10.

Figure 6:
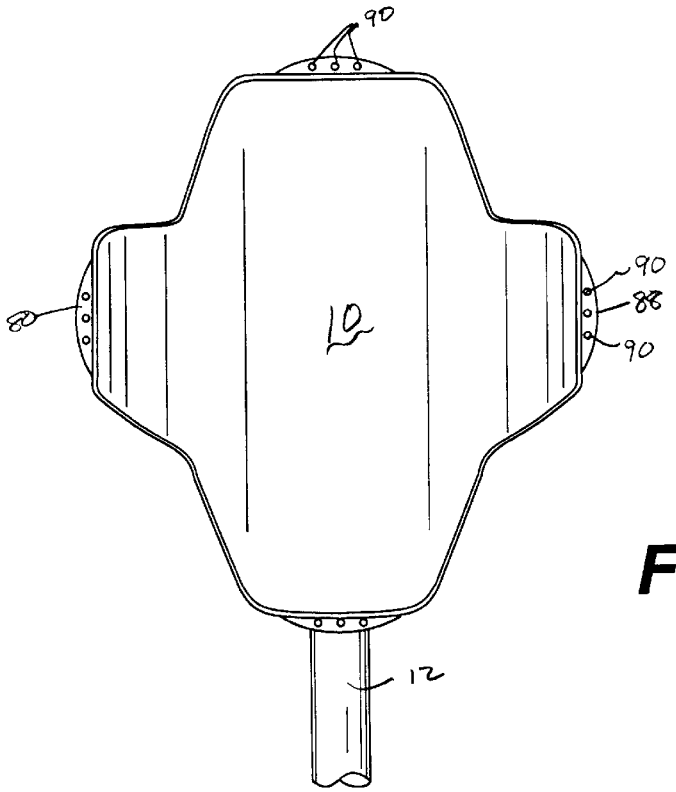
FIG. 6 is an elevational view of an alternative embodiment of the novel exercise device in which the identifying lights are a part of the molding of the novel exercise device.
Figure 7:
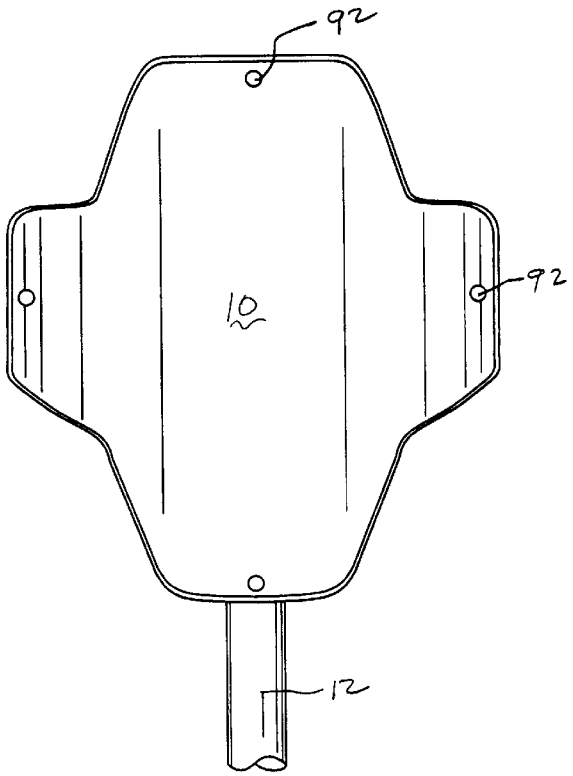
FIG. 7 is a front view of a further embodiment of the novel exercise device illustrating an alternative arrangement for incorporating identifying lights within the exercise device.

Identification light 72, 74, 76 and 78 may be modified in a variety of ways to suit particular requirements and can be housed in a resilient tubing surrounding exercise body 10 as illustrated in FIG. 6. The flexible tubing 88 internally support small LED lights 90 that may be activated by electronic housing 60 in a sequenced pattern corresponding to a desired exercise or training routine. The flexible tubing 88 may be utilized as a molding material surrounding the entire perimeter of exercise body 10 (not shown) or be visible only in certain locations on the exercise body as illustrated in FIG. 6. Identification lights 72, 74, 76 and 78 may also be disposed in core backing 34 and small hole 92 can be provided in outer surface 30 and layer 32 to allow the light to shine through exercise body 10 to provide identification of the target area on the exercise device that needs to be contacted during the exercise routine as is illustrated in FIG. 7.

As heretofore discussed the target area identification means can include lights as previously described or may be sound, motion or other means for identifying a particular segment of a target. The exercise body 10 may also be modified to provide a symmetrical or asymmetrical target.

Figure 9:
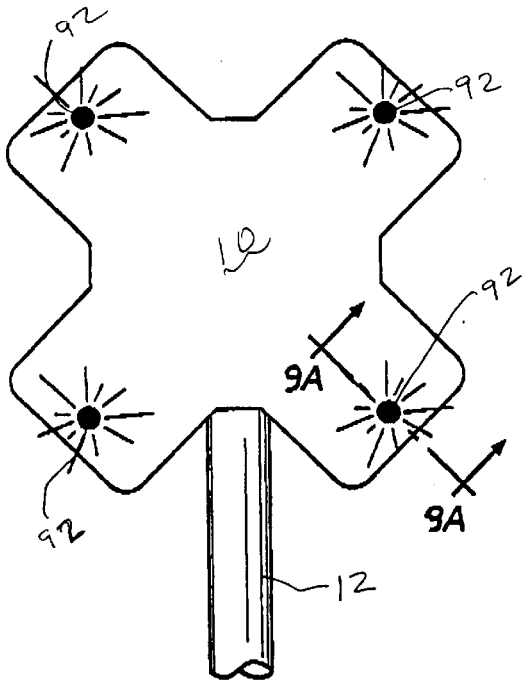
FIG. 9 is a front view of an alternative embodiment of the novel exercise device illustrating an alternative embodiment for the target area identification means.
Figure 9A:
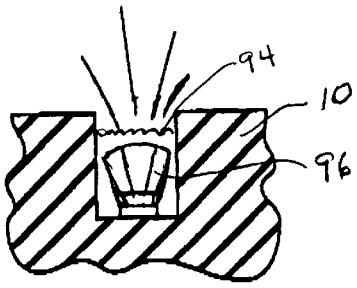
FIG. 9A is a segment of FIG. 9 taken along the line 9A—9A of FIG. 9.

Referring now to FIGS. 9 and 9A exercise body 10 includes a plurality of holes 92 covered by a screen 94 covering a speaker 96 for emitting a sound identification of a particular segment or target area to be struck. As will be recognized by those skilled in the art, the same or different sounds may be utilized to identify a particular target area as well as the utilization of a vibrator for selectively vibrating the target area. Such target area identification means will be referred to as identification means.

Figure 10:
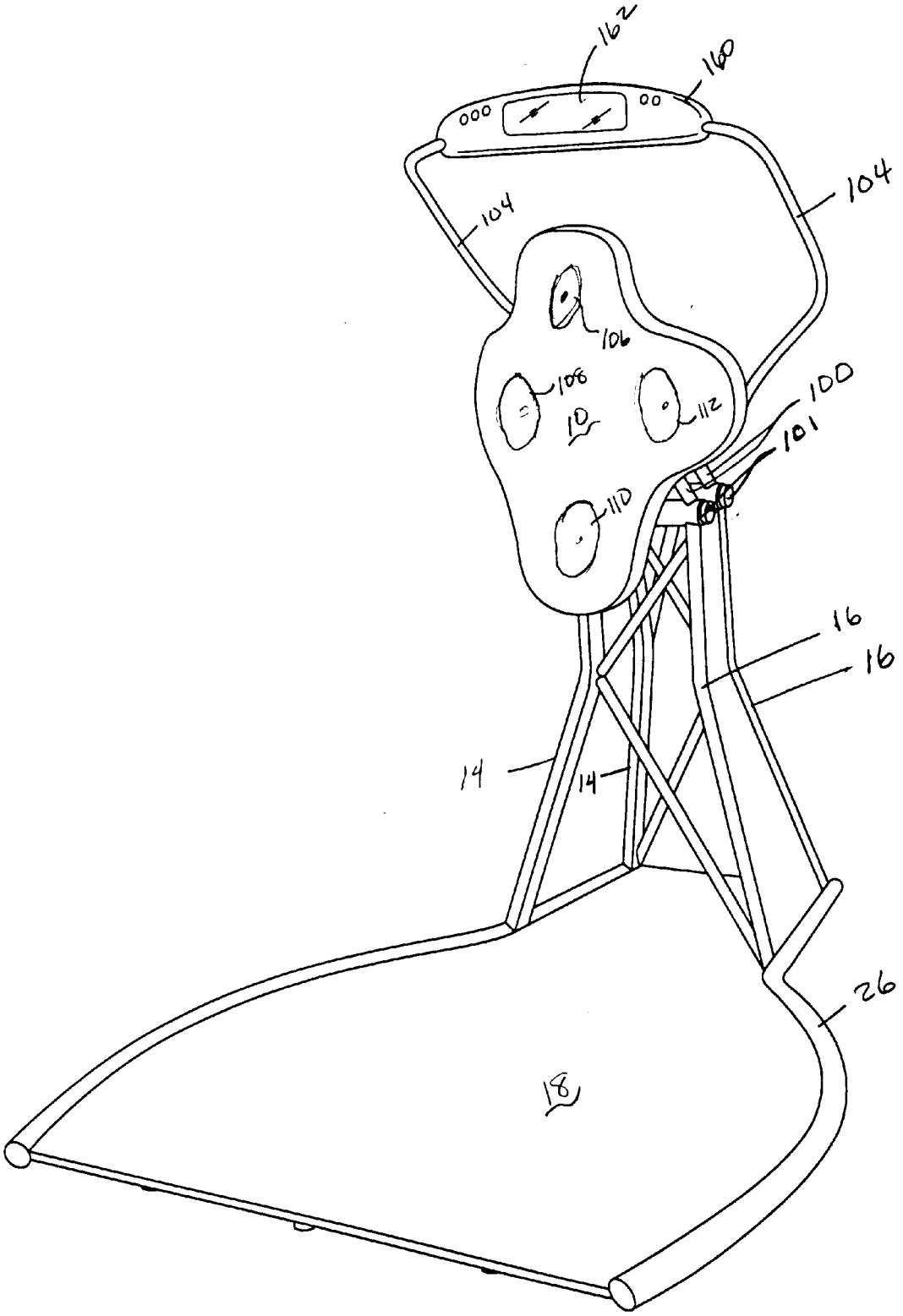
FIG. 10 is a perspective view of a further alternative embodiment of the novel exercise device with support and computer display.
Figure 11:
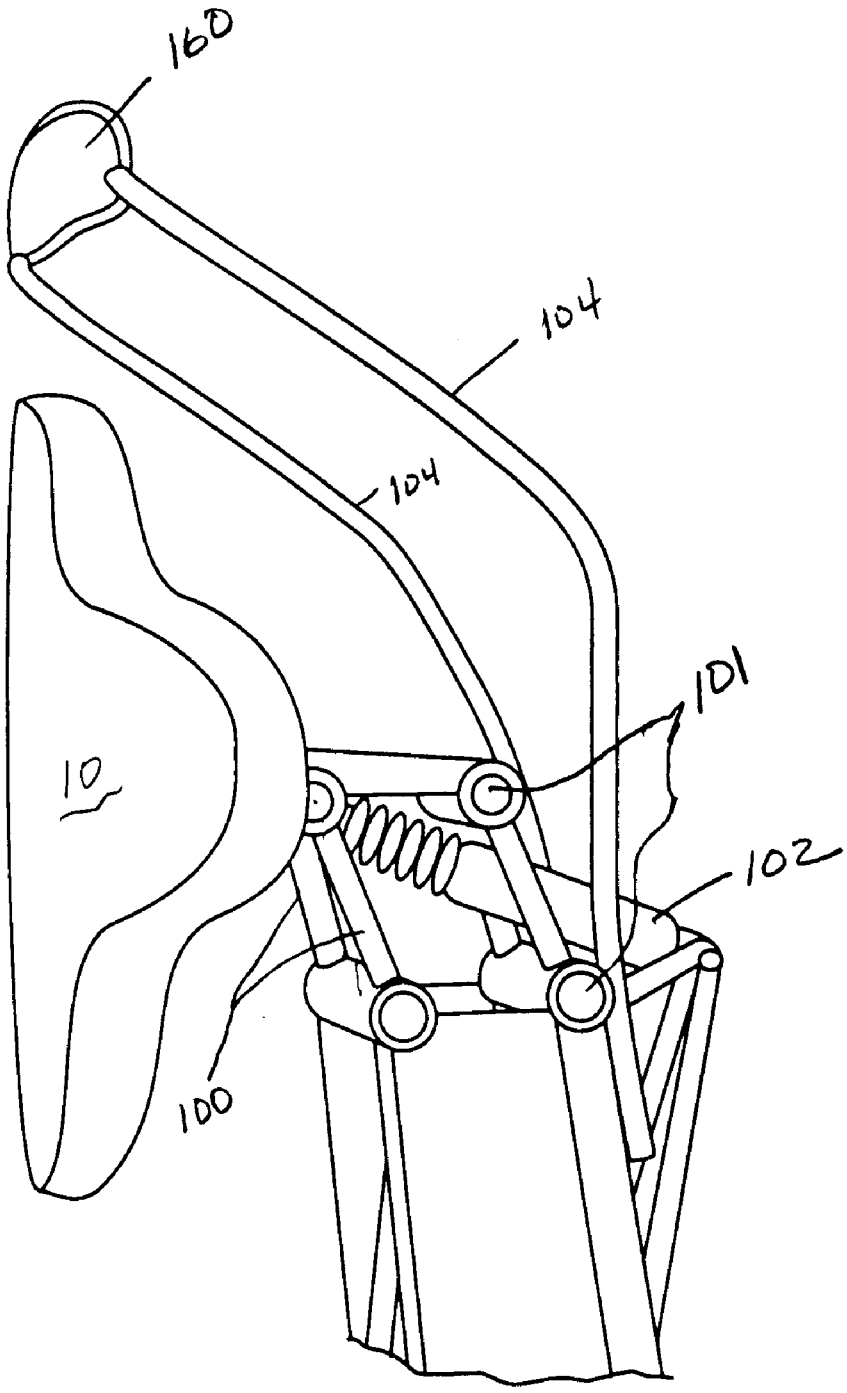
FIG. 11 is a fragmentary side view of a portion of the support and exercise device of FIG. 10.

Exercise body 10 is resiliently mounted to platform 18 through shock absorber 24 or other device for imparting resiliency between platform 18 and exercise body 10 or by resiliently mounting the exercise body 10 through a resilient shock absorber device disposed between exercise body 10 and legs 14 and 16 as illustrated in FIGS. 10 and 11. The exercise body 10 as illustrated in FIGS. 10 and 11 includes a platform 18, a U-shaped frame 26 and legs 14 similar to the components previously discussed with regard to FIG. 1. The exercise device 10 in FIG. 11 includes a plurality of links 100 which preferably may include individual tensioning nuts (not shown) for increasing the tension in each of the individual joints 101. The links 100 impart resiliency to the exercise device at the interface between the exercise body 10 and the legs 14 and 16 by utilizing a shock absorber 102 for dampening punches, kicks and other shocks delivered to the exercise body 10. The exercise body as illustrated in FIGS. 10 and 11 includes arms 104 for supporting an electronic housing 160 and a display and control panel 162 which will be described hereinafter in greater detail.

Exercise body 10 in FIG. 10 includes identification lights 106, 108, 110 and 112 that are disposed in a luminescent, transparent or translucent gel-like material which transfers light from a small light source or LED 114 through the luminescent gel-like material to provide identification means for the target area to be struck. Each of the identification lights are activated by the microprocessor in the electronics housing 160.

Figure 12:
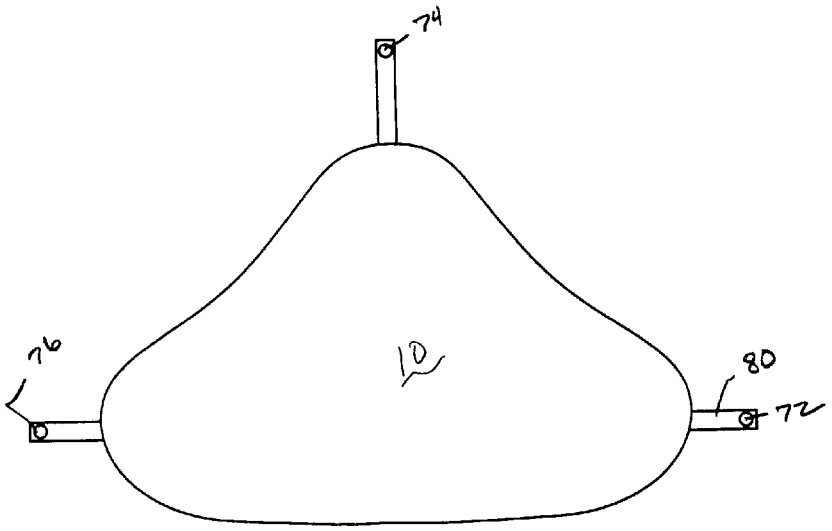
FIG. 12 is a further embodiment of the novel exercise device illustrating an alternative configuration for the exercise device.
Figure 13:
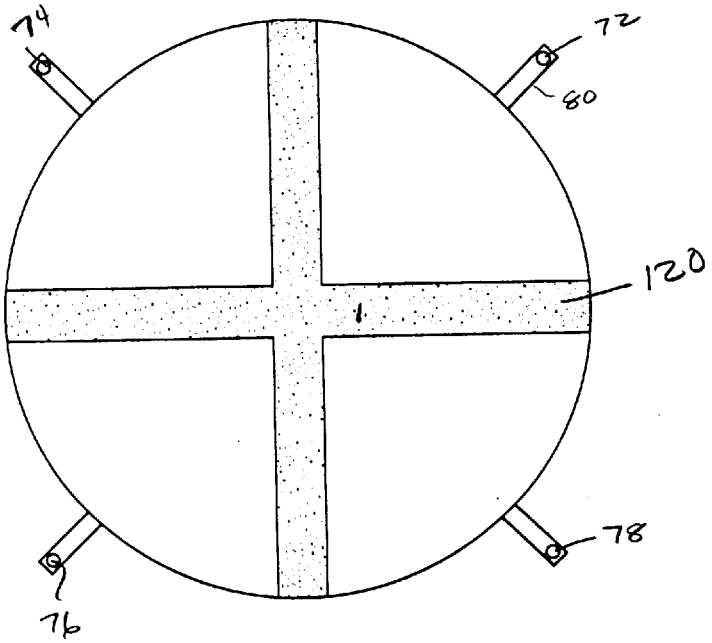
FIG. 13 is a further embodiment illustrating a further alternative configuration for the novel exercise device.

The exercise body 10 may be composed of any resilient material capable of withstanding punches, kicks and blows and may be of a symmetrical or non-symmetrical configuration. As illustrated in FIG. 12 the exercise body 10 is of a triangular configuration and includes semi-resilient stalks 80 and identification lights 72, 74 and 76. The exercise body illustrated in FIG. 13 is of a circular configuration and includes a segment tape or marker 120 to divide the exercise body into four target areas identified by identification lights 72, 74, 76 and 78. Identification lights 72, 74, 76 and 78 are disposed on semi-resilient stalk 80 as heretofore discussed. Segment tape or marking 120 is optional but may be of assistance to the athlete in certain embodiments of the invention where the strength of the strike or the exact position of the blow from the athlete is measured and recorded by the microprocessor in measuring skill or where the force of the blow or time elapsed is measured to determine the amount of calories burned in a particular exercise regimen.

Figure 14:
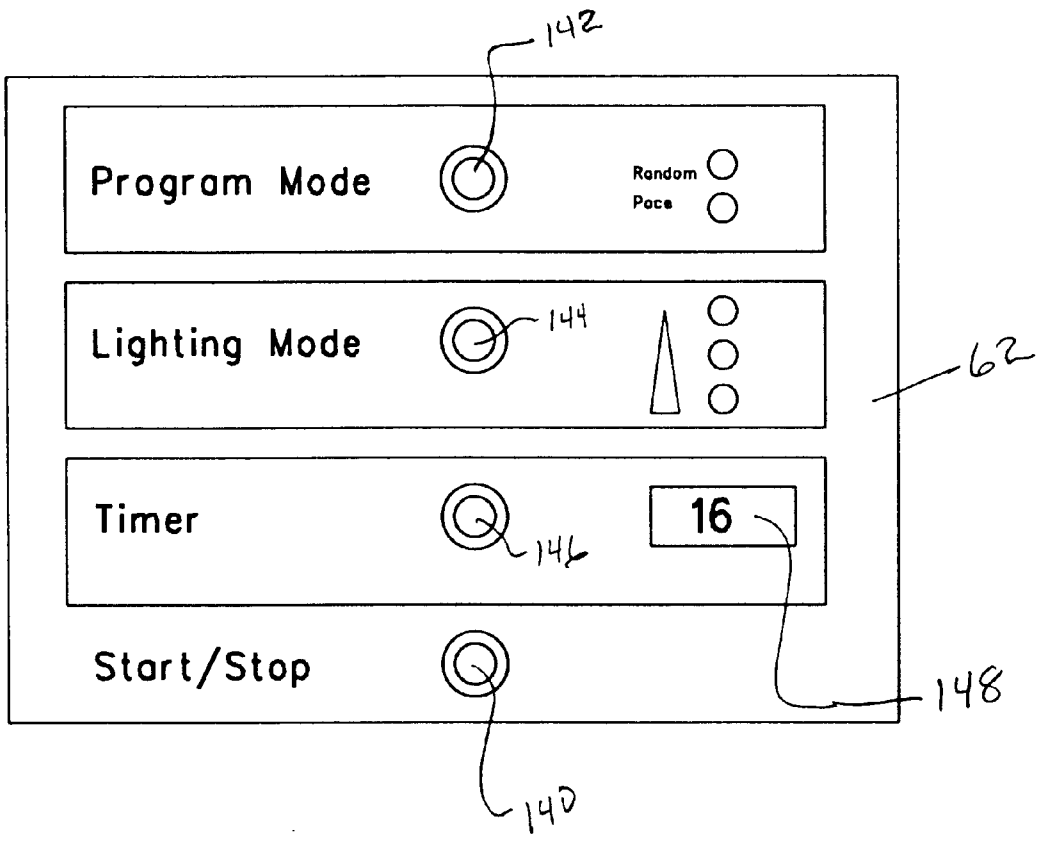
FIG. 14 is a front view of a display in accordance with the preferred embodiment of the invention.
Figure 15:
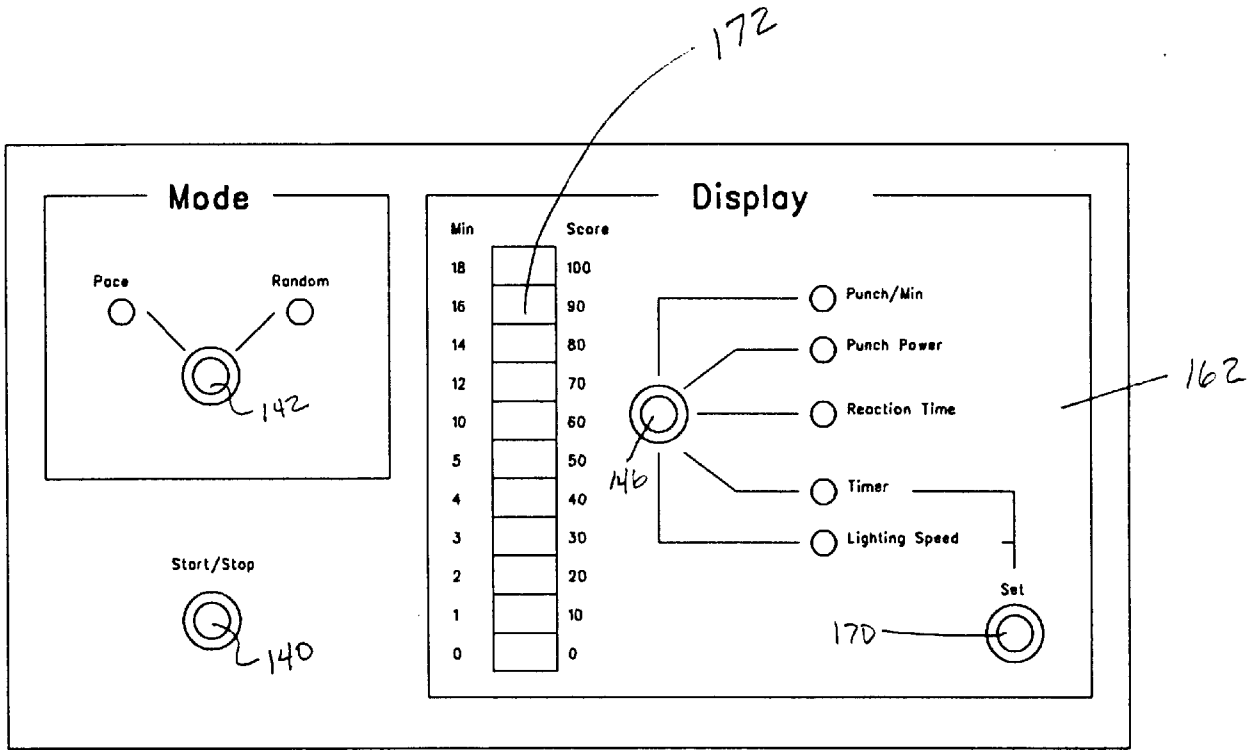
FIG. 15 is an alternative embodiment of a display constructed in accordance with the invention as illustrated in FIG. 10.

Referring now to FIGS. 1, 3, 14, 16, 18 and 20, the preferred embodiment and best mode of the invention is illustrated including circuitry for the electronic controller, a logic block diagram for the electronic controller and a front panel for the display and control panel 62. Panel 62 as illustrated in FIGS. 3 and 14 may be of any desired configuration including circular or rectangular and may include a start/stop switch 140, a program mode button 142 for selecting between various types of workouts which, as indicated in FIG. 14, can be a random workout wherein the identification lights 72, 74, 76 and 78 are randomly accessed or can include a pace mode in which the identification lights 72, 74, 76 and 78 are activated in a particular sequence associated with a particular workout. For example, the pace could include specific types of workouts, such as upper body, lower body, or specific areas of the body, as will be controlled by the software and particular mode selected by the athlete. In addition a lighting mode button 144 is provided to increase or decrease the speed at which the identification lights are activated as well as decreasing the time allowed to hit a particular target area. A timer button 146 with display 148 indicates the period of time that the exercise device has been used.

As will be recognized in the discussion of other embodiments of the invention, other types of panels, workout program modes, timers and displays may be utilized to provide additional advantages in utilizing the novel exercise device for training purposes with respect to various martial arts and sports by including modes for training and increasing strength, speed or working on specific areas of the body. These training and exercise routines directed toward specific weaknesses can be identified by the microprocessor and related software to provide specific training instruction that can be sequenced into the workout routine to suit the requirements of the individual athlete. In addition, display 148 can be further segmented into not only time of the exercise, but also the amount of calories burned based upon the intensity of the workout and the intensity of the forces directed against the novel exercise body 10 to provide a complete analysis of workout or training information analyzed by the microprocessor to assist in the training of the athlete.

Figure 16:
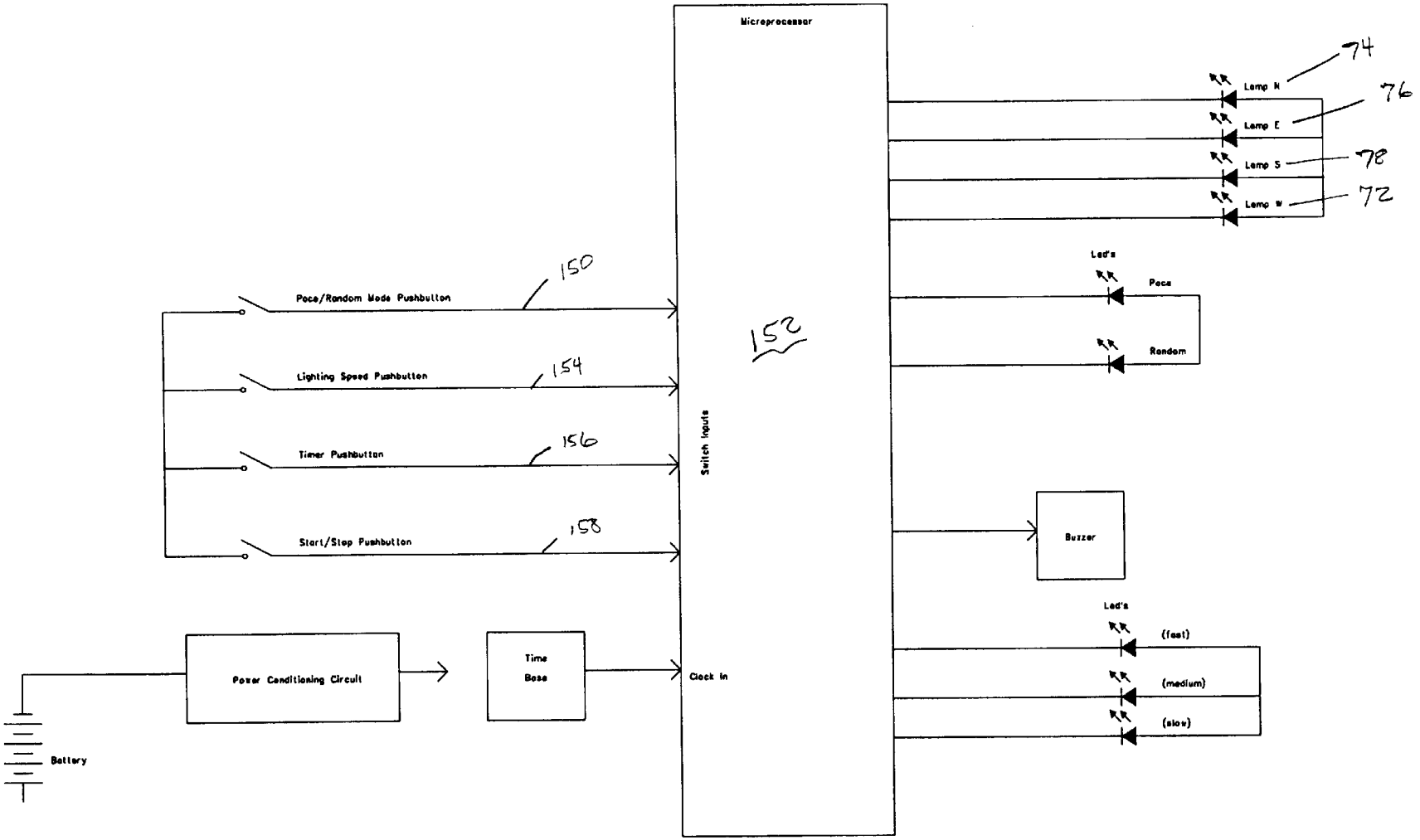
FIG. 16 is a schematic diagram of an electronic controller for operating the exercise device in accordance with the preferred embodiment of the invention.
Figure 18:
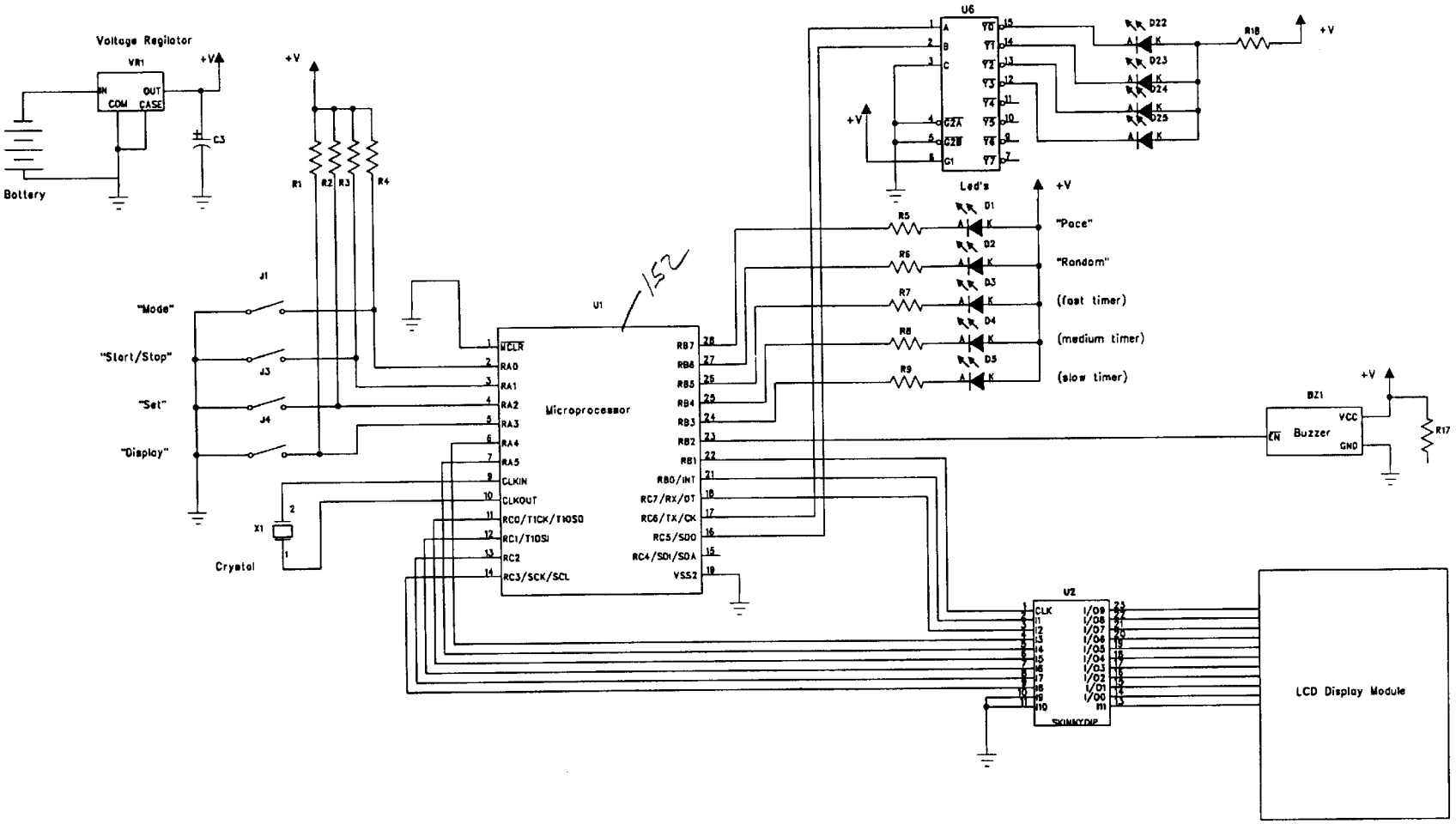
FIG. 18 is a diagrammatic view of a circuit for operating the device as illustrated in FIG. 1.
Figure 20:
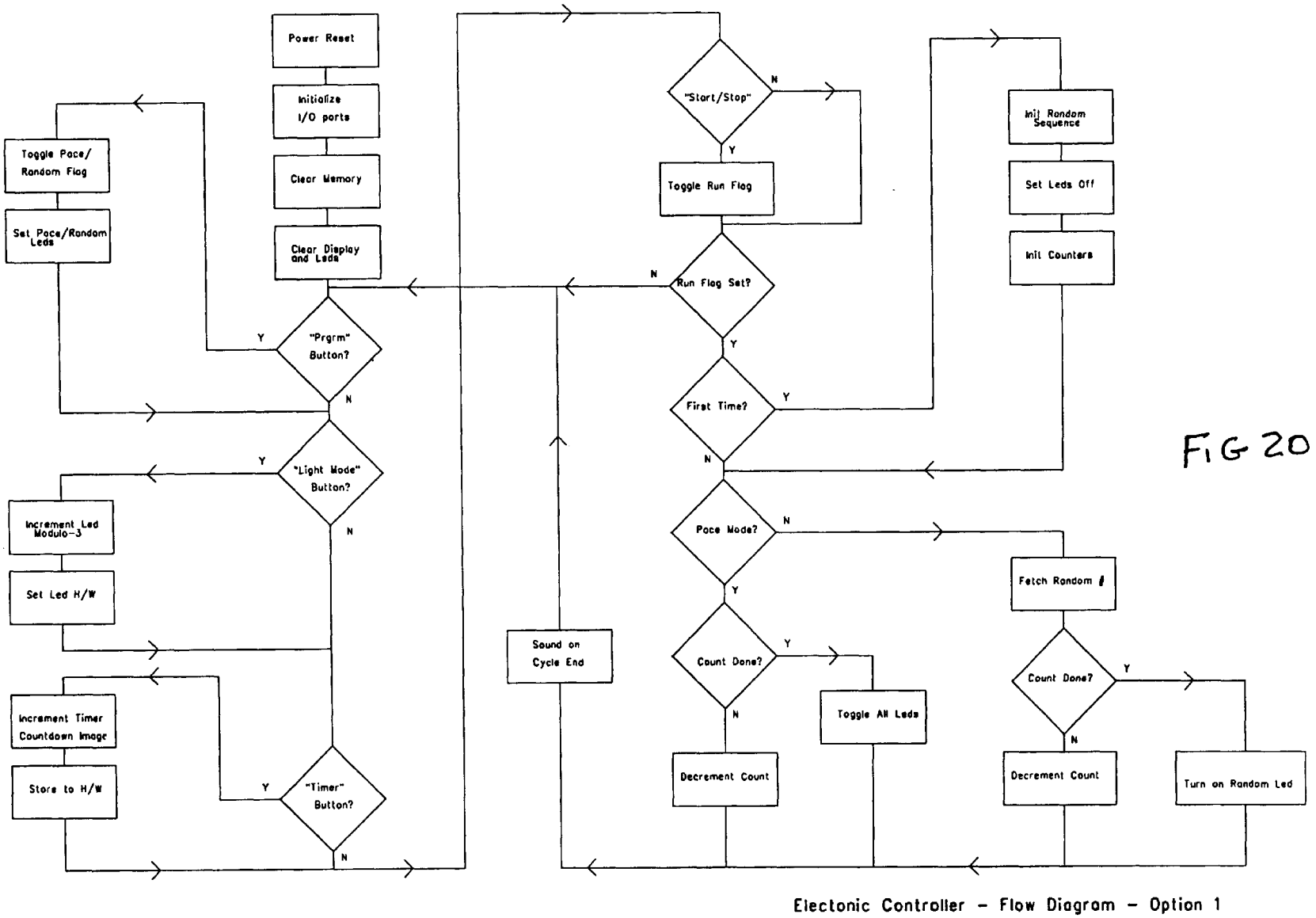
FIG. 20 is a flow chart of a logic diagram for operating the device as illustrated in FIG. 1.

The display and control panel is connected through wiring to an electronic controller as illustrated in FIG. 16 to provide inputs to the microprocessor 152 from the program mode button 142 for the selection of the program mode (pace or random) setting as illustrated by line 150 to microprocessor 152. Similarly lighting mode button 144 operates through a switch to input the lighting activation speed through line 154 to microprocessor 152. Timer button 146 goes through a switch through line 156 to microprocessor 152 and start/stop button 158 goes through a switch through line 158 to provide start/stop information to microprocessor 152. In addition a power conditioning circuit and a time base provide information to the microprocessor to activate the identification lights 74 (lamp N) identification light 76 (lamp E), identification light 78 (lamp S) and identification light 72 (lamp W). A hardware diagram for the microprocessor 152 is illustrated in FIG. 18 which includes various input and output circuits which control not only the lighting and the activation of the lighting, but also the display 62. The logic flowchart is illustrated in FIG. 20 which provides for the running of the novel exercise device in accordance with the preferred embodiment of the invention as illustrated in FIG. 1.

Referring now to FIGS. 10, 15, 17, 19, 21(A) and 21(B), an alternative embodiment of the invention is illustrated in which the novel exercise body 10 is constructed for gym, health club or fitness center applications wherein the electronic housing 160 (FIG. 10) includes a more sophisticated display and control panel 162. This version of the novel exercise device 10 includes a start/stop button 140, a program mode button 142 which may provide access to a variety of paces, training and exercise routines, a timer button 146 and a set button 170 which allows the athlete to select between various types of programs controlled by the microprocessor which include the time for punching, measurement of punching power, reaction time, timing and lighting speed which then can be measured by the microprocessor.

Figure 17:
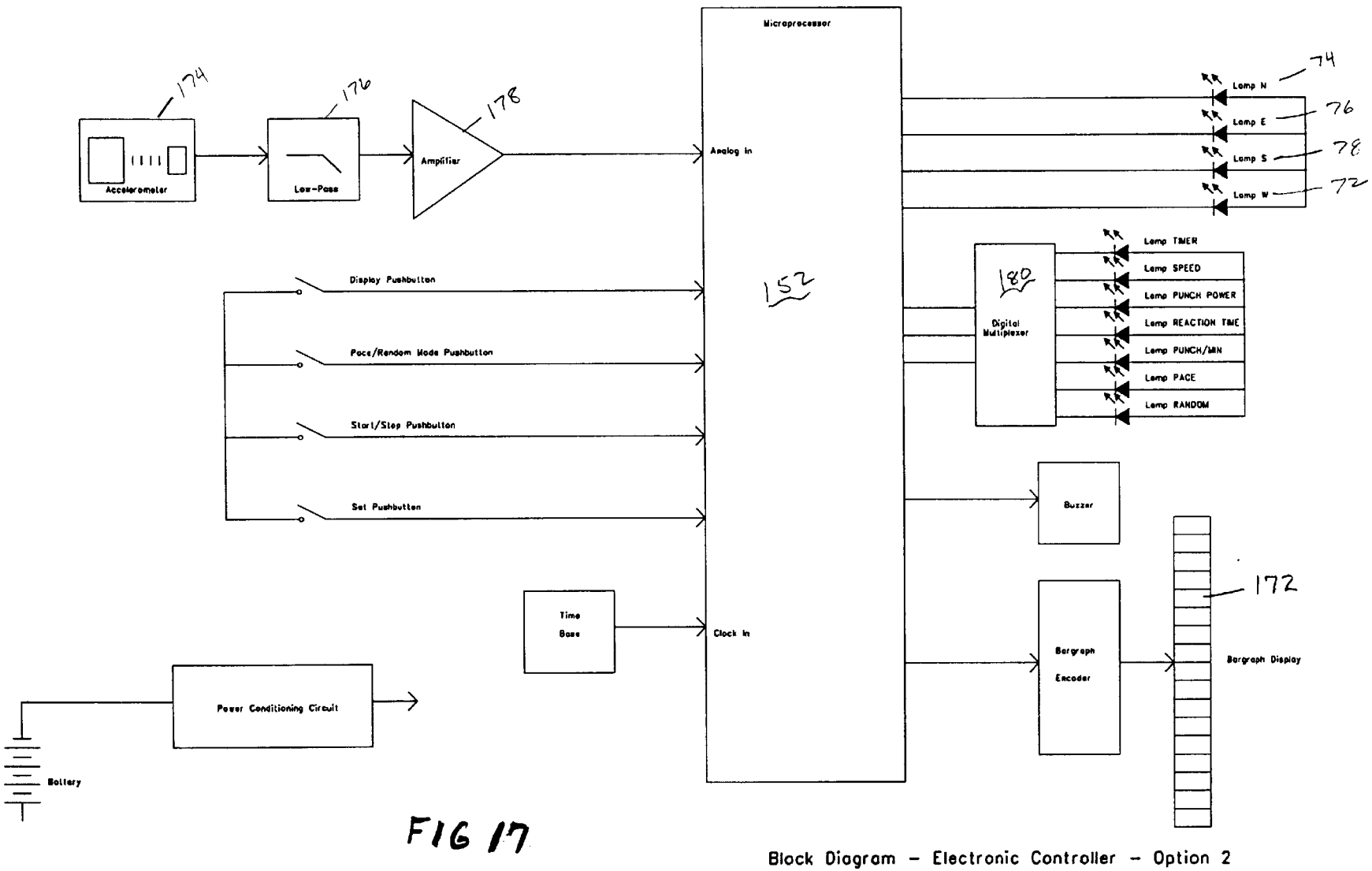
FIG. 17 is an alternative embodiment of an electronic circuit for operating the device as illustrated in FIG. 10.

The display 162 further includes a scoring display 172 which provides a scoring readout based upon the intensity of the workout as well as the length of the workout. In this embodiment of the invention energy transferred to exercise body 10 may be measured through the various joints 101 through the use of an accelerometer 174 (FIG. 17) through a low pass device 176 and into an amplifier 178 as an additional input to microprocessor 152. As will be recognized by those skilled in the art FIG. 17 includes similar components as has heretofore been described with respect to FIG. 16 and will not be repeated. FIG. 17 however also includes a digital multiplexer 180 for recording reaction time, punch power, pace and other parameters for providing a digital readout to scoring display 172.

Figure 19:
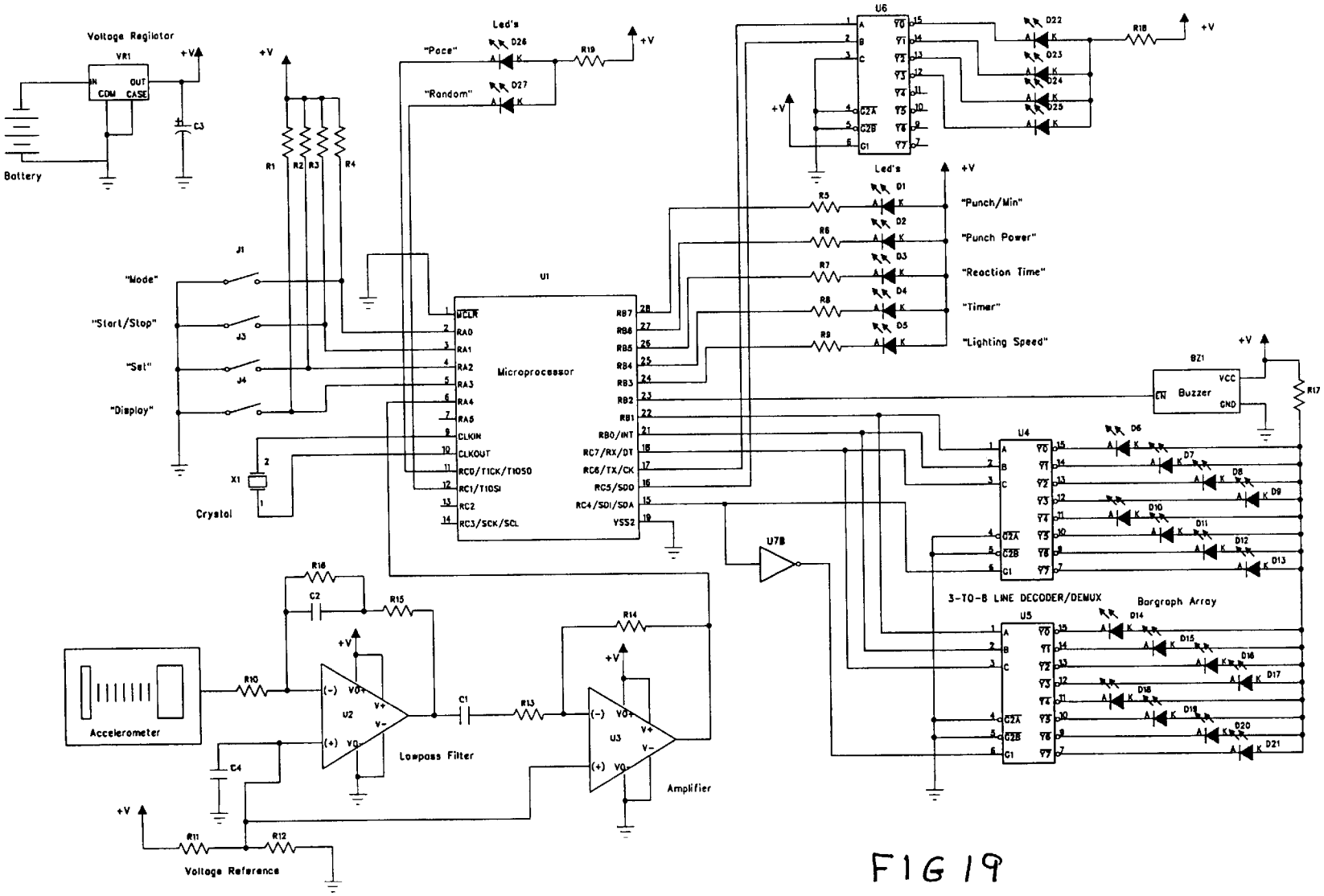
FIG. 19 is a diagram of an electronic controller for operating the device as illustrated in FIG. 10.
Figure 21A:
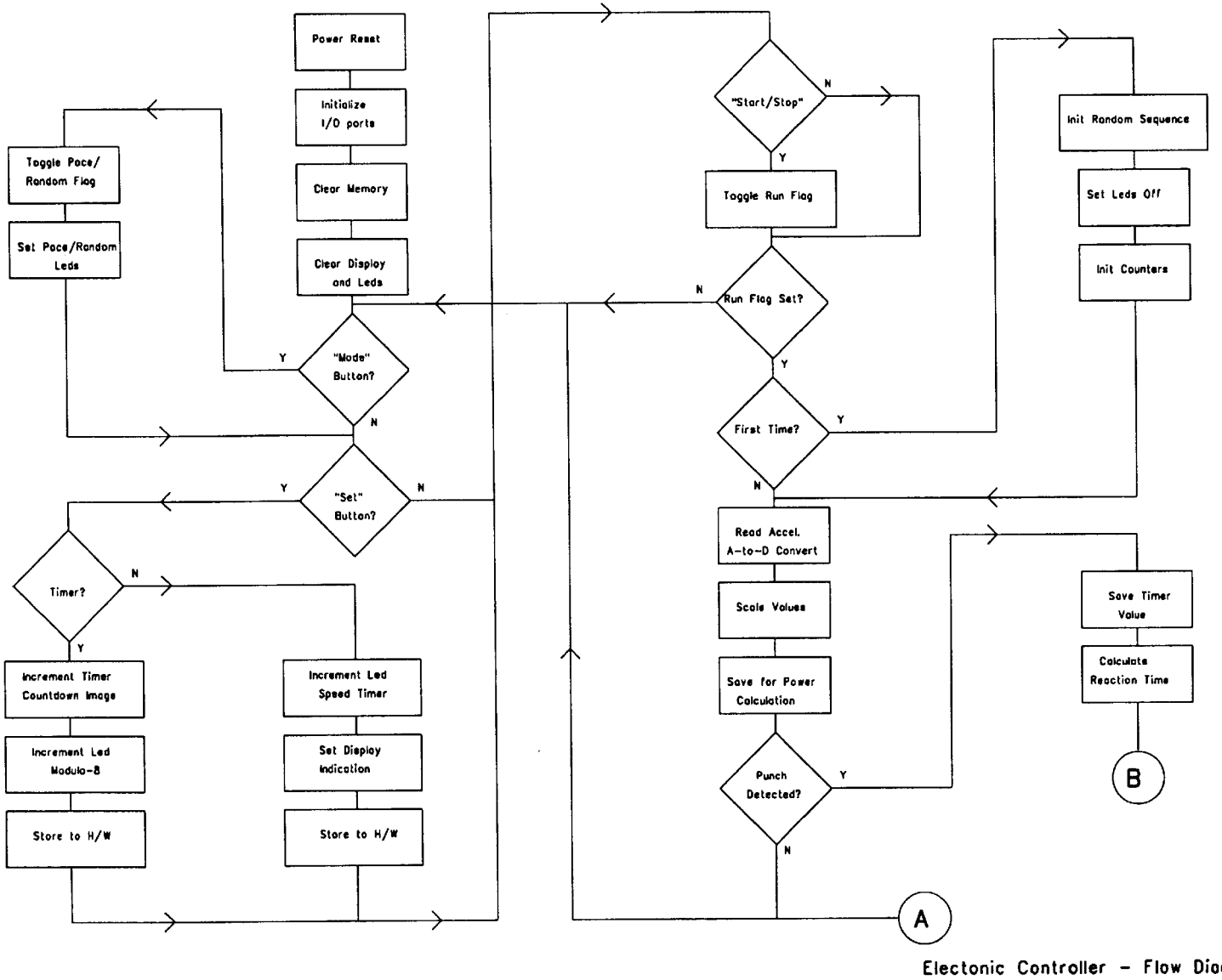
FIG. 21(A) and 21(B) is a flow chart of a logic diagram as may be utilized to operate the device illustrated in FIG. 10.
Figure 21B:
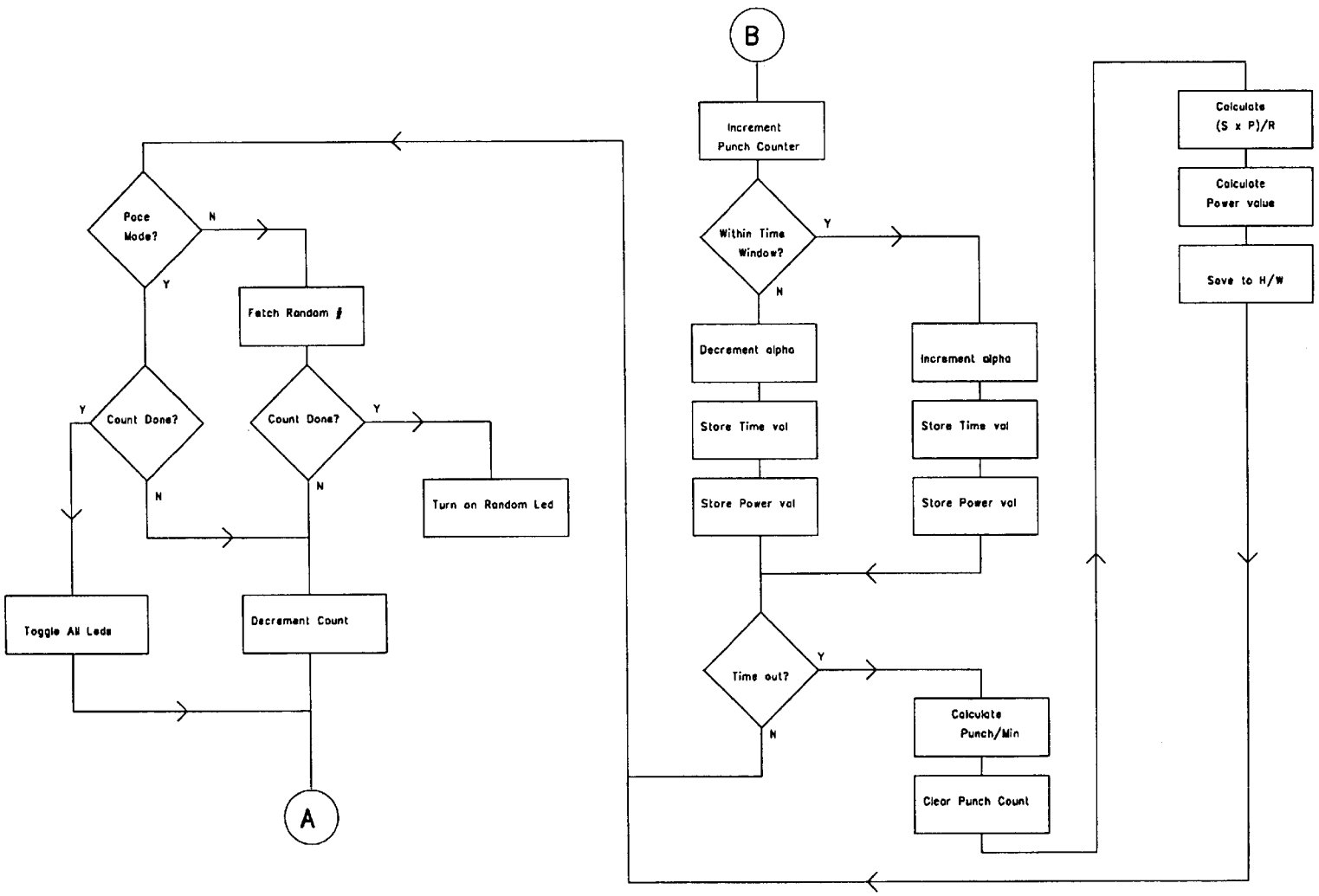

FIG. 19 includes circuitry similar to that described with respect to FIG. 18 and includes additional circuitry for the digital multiplexer for measuring punch power, reaction time, timing of the punch, power of the punch, etc. FIGS. 21(A) and 21(B) include a flowchart similar to that described with respect to FIG. 16 and includes the processing of additional values for punching speed, punching power and other parameters measured and stored by the microprocessor 152 for providing workout information displayed in scoring display 172.

In operation the device of the invention provides a wide range of latitude in exercise routines to cover a variety of boxing and martial arts training focusing on speed, strength, stamina and other parameters that can be measured through the exercise body 10 and can be utilized by the microprocessor to pinpoint areas of weakness for specific advanced training utilizing the novel exercise device of the invention. The novel exercise body 10 can be adjusted on stand 12 in a number of ways to raise or lower the exercise device on stand 12 for specific training of upper and lower parts of the body and the display may be modified in various ways to record the strength of the hit to allow the athlete to know if a knock-out punch has been thrown as well as measuring reaction time and overall stamina in the use of the exercise device.

The athlete support pad may be constructed of an elastomeric material or a fabric material and placed in the U-shaped frame 26 to provide stability and slip-resistance. In addition various non-slip supports may be utilized between U-shaped frame 26 and the floor to cushion and protect the floor during exercise workout routines. As heretofore described the novel exercise device may be of various sizes, shapes and configurations to suit particular requirements, and identification means may be placed in various locations on, near or around a particular target segment and a segment tape or markings may be utilized to identify various target areas identified with the identification means.

The novel exercise device, microprocessor and associated software measures and records elapsed time between the time the identification means is activated and the time a specific segment of the exercise device is contacted so as to record reaction time in throwing a punch, as well as follow-up hits as the identification means moves from segment to segment. The identification means identifies a particular segment on the exercise body by a software based activation of the identification means. The identification means which, in the preferred embodiment, is a lighting system is preferably resiliently mounted to the exercise body 10 so that, if the identification light is accidentally hit, such hitting of the identification light would not incapacitate the identification light or cause injury to the athlete.

The invention, as will be recognized by those skilled in the art, provides a wide range of athletic workouts and both amateur and professional training systems for choreographing boxing, martial arts or other punching, kicking or martial art programs which are controlled by the microprocessor and software which may be programmed to provide various levels of instruction as well as providing workouts tailor-made to a particular athlete. In addition the microprocessor and associated software can be programmed to advise the athlete of the reaction time in relation to a particular desired reaction time and these may be scored at various levels on the scoring display such as amateur, professional, expert or other levels including comparison with recognized sports figures which may be programmed into the microprocessor. The microprocessor can be programmed to measure the force of the punch, the number of punches per minute, or timed round, the number of free set rounds with a buzzer to signal rest periods, and the resumption of boxing, the aggregate calories burned, the speed of the punch, the speed of combination punches or combinations of all of the foregoing in providing various routines desired by the athlete.

As will be recognized by those skilled in the art, the invention may be modified in a number of ways for various applications for professional and amateur training in boxing and martial arts as well as for applications in the gym or at home. The exercise device may be configured in a number of symmetrical and asymmetrical shapes, and the identification means or lights may be deployed in a number of different arrangements to suit particular requirements. In addition the microprocessor can be programmed in a variety of ways to provide not only various levels of skill but also specific routines designed to concentrate on specific weaknesses or areas of the athlete that need concentration or work without the intervention of a special trainer.

The invention may be implemented in a variety of ways by those skilled in the art including the manner in which the base and frames are assembled and manufactured. These components can be manufactured for bolting together for purposes of shipment or desired applications. These and other modifications may be readily accomplished by those skilled in the art. As used herein and in the following claims, the word 'comprising' or 'comprises' is used in its technical sense to mean the enumerated elements include but do not exclude additional elements which may or may not be specifically included in the dependent claims. It will be understood such additions, whether or not included in the dependent claims, are modifications that both can be made within the scope of the invention. It will be appreciated by those skilled in the art that a wide range of changes and modification can be made to the invention without departing from the spirit and scope of the invention as defined in the following claims.

What is claimed is:

1. An exercise device comprising:

(a) an exercise bag having a flexible outer surface;

(b) a substantially rigid back attached to said flexible outer surface;

(c) a first identification means disposed on said flexible outer surface for identifying separate target areas on said flexible outer surface;

(d) a second identification means disposed outside of said separate target areas and said first identification means for periodically identifying one of said separate target areas on said flexible outer surface;

(e) a microprocessor disposed on said substantially rigid back for controlling the operation of said second identification means; and (f) software for operating said microprocessor.

2. The exercise device of claim 1 further comprising a stand for mounting said substantially rigid back.

3. The exercise device of claim 2 wherein said stand includes a platform.

4. The exercise device of claim 3 wherein said platform includes a resilient covering.

5. The exercise device of claim 3 further comprising a resilient connection between said substantially rigid back and said platform.

6. The exercise device of claim 5 wherein said resilient connection is disposed between said substantially rigid back and said stand.

7. The exercise device of claim 5 wherein said resilient connection is disposed between said platform and said stand.

8. The exercise device of claim 1 wherein said first identification means is provided by the shape of said exercise bag.

9. The exercise device of claim 1 wherein said first identification means is provided by a marking on said exercise bag.

10. An athletic training device comprising:

(a) a body having a resilient exercise surface;

(b) a first identification means provided by said resilient exercise surface to identify a plurality of exercise target areas;

(c) a second identification means for periodically identifying one of said plurality of exercise target areas provided by said first identification means, said second identification means disposed at a remote location from said plurality of exercise target areas; and (d) a processor for controlling the operation of said second identification means.

11. The athletic training device of claim 10 further comprising a substantially rigid back surface and a stand slidably attached to said substantially rigid back surface.

12. The athletic training device of claim 10, further comprising a substantially rigid back surface and wherein said second identification means is a plurality of lights resiliently mounted to said substantially rigid back surface.

13. The athletic training device of claim 12 wherein said remote location of said plurality of lights is on semi-resilient stalks mounted on said substantially rigid back surface.

14. The athletic training device of claim 12 wherein said remote location and resilient mounting of said plurality of lights is provided by a transparent gel and said remote location is on substantially rigid back surface.

15. The athletic training device of claim 10 wherein said remote location of said plurality of lights is within a flexible molding attached to the outer periphery of said substantially rigid back surface.

16. The athletic training device of claim 10 wherein said first identification means is provided by the shape of said body and includes a plurality of lobed shaped projections extending from said resilient exercise surface.

17. The exercise device of claim 10 further comprising sensor means for timing elapsed time between the activation of said second identification means and contact with one of said plurality of exercise target areas.

18. An exercise apparatus comprising:

(a) a member having a front impact surface and a rear mounting surface;

(b) a first identification means provided by said member for identifying separate target areas on said front impact surface;

(c) a second identification means mounted outside of said first identification means and outside of said separate target areas, said second identification means providing for the periodic identification of said separate target areas on said front impact surface;

(d) a plurality of sensors wherein each sensor of said plurality of sensors is disposed in said member intermediate said front impact surface and said rear mounting surface and disposed at a remote location from said second identification means;

(e) a microprocessor for controlling the operation of said second identification means and for processing data received from said plurality of sensors; and (f) software for operating said microprocessor.

19. The exercise apparatus of claim 18 wherein said second identification means is a plurality of identification lights.

20. The exercise apparatus of claim 19 further comprising means for timing the elapsed time between the activation of one of said identification lights and the time of impact on one of said plurality of exercise target areas on said front impact surface.

21. The exercise apparatus of claim 19 further comprising means for measuring the force exerted on one of said plurality of exercise target areas on said front impact surface.

22. The exercise apparatus of claim 21 wherein said means for measuring force is an accelerometer.

23. The exercise apparatus of claim 19 further comprising a scoring display.

24. The exercise apparatus of claim 19 wherein said first identification means is provided by the shape of said front impact surface.

25. The exercise apparatus of claim 19 wherein said first identification means is provided by marking said front impact surface.

* * * * *